US011659905B2

(12) United States Patent
Kerr De Leon

(10) Patent No.: US 11,659,905 B2
(45) Date of Patent: May 30, 2023

(54) TRAVEL CASE

(71) Applicant: Jennifer Kerr De Leon, Nashville, TN (US)

(72) Inventor: Jennifer Kerr De Leon, Nashville, TN (US)

( * ) Notice: Subject to any disclaimer, the term of this patent is extended or adjusted under 35 U.S.C. 154(b) by 0 days.

(21) Appl. No.: 16/835,511

(22) Filed: Mar. 31, 2020

(65) Prior Publication Data

US 2020/0375327 A1 Dec. 3, 2020

Related U.S. Application Data

(63) Continuation of application No. 16/424,940, filed on May 29, 2019, now Pat. No. 10,602,818.

(51) Int. Cl.

| | |
|---|---|
| ***A45C 5/00*** | (2006.01) |
| ***A45D 40/24*** | (2006.01) |
| ***B65D 25/10*** | (2006.01) |
| *B65D 51/24* | (2006.01) |
| *A45C 11/00* | (2006.01) |

(52) U.S. Cl.

CPC ..... *A45C 5/005* (2013.01); *A45D 40/24* (2013.01); *B65D 25/10* (2013.01); *B65D 25/107* (2013.01); *A45C 2011/007* (2013.01); *A45D 2200/25* (2013.01); *B65D 51/245* (2013.01); *Y10S 206/823* (2013.01)

(58) Field of Classification Search

CPC .... A45D 40/24; A45D 2200/25; A45D 34/00; A45C 2011/007; A45C 203/008; A45C 11/005; A45C 2011/006; B65D 25/107; B65D 25/10; B65D 5/5206; B65D 51/245; B25H 3/003; Y10S 206/823

USPC ..... 206/581, 456, 214, 758, 823, 5.1, 499, 206/557–567; 211/11

See application file for complete search history.

(56) References Cited

U.S. PATENT DOCUMENTS

| | | | | |
|---|---|---|---|---|
| 3,637,278 A * | 1/1972 | Easterbrooks | ..... | A45D 40/22 312/227 |
| 4,580,586 A * | 4/1986 | Kitoh | ..... | A45D 40/22 132/315 |
| 5,383,550 A * | 1/1995 | Tsao | ..... | A45C 11/005 206/5.1 |

(Continued)

OTHER PUBLICATIONS

3E8, Contact Lenses Dispenser, Nov. 10, 2017, from Thingiverse.com website: https://www.thingiverse.eom/make:403433 (Year: 2017).*

*Primary Examiner* — Mollie Impink

(74) *Attorney, Agent, or Firm* — Robinson IP Law, PLLC

(57) ABSTRACT

A modular case includes: a base having opposing side rails formed along sides of the base, the side rails forming elongate channels therein; a plurality of container modules removably secured on the base, the plurality of container modules having a base plate having a width extending across a width of the base such that sides of the base plate fit within the elongate channels formed by the side rails of the base, one or more containers formed on the base and extending upwardly therefrom, the one or more containers including an open end, and one or more caps secured to the one or more containers over the open end. Sides of the plurality of base plates slidably engage the elongate channels formed on the base such that the plurality of container modules are removably secured to the base.

18 Claims, 7 Drawing Sheets

(56) References Cited

U.S. PATENT DOCUMENTS

| | | | | |
|---|---|---|---|---|
| 5,497,879 | A * | 3/1996 | Kao | B65D 43/0218 206/389 |
| 5,938,031 | A * | 8/1999 | Woods | B65D 25/10 206/425 |
| 6,585,112 | B2 * | 7/2003 | Levin | A45C 11/182 206/39 |
| 8,418,852 | B2 * | 4/2013 | Ziemba | A45D 33/28 |
| 8,857,613 | B1 * | 10/2014 | Harris | B65D 73/0021 206/730 |
| 2007/0000792 | A1 * | 1/2007 | Newman | B65D 21/0204 206/5.1 |
| 2011/0061675 | A1 * | 3/2011 | McKinley | A45D 33/20 132/296 |
| 2013/0334095 | A1 * | 12/2013 | Bruns | B65D 25/00 206/758 |
| 2016/0270507 | A1 * | 9/2016 | Thompson | A45D 33/006 |
| 2017/0156472 | A1 * | 6/2017 | Lin | A45D 33/003 |
| 2018/0263361 | A1 * | 9/2018 | Langdon | A45D 33/20 |
| 2020/0146421 | A1 * | 5/2020 | Chen | A45D 33/008 |

* cited by examiner

TRAVEL CASE

CROSS-REFERENCE TO RELATED APPLICATION

This application claims priority to and is a continuation of U.S. patent application Ser. No. 16/424,940 filed on May 29, 2019, for a Travel Cosmetic Kit, the contents of which are incorporated herein by reference in its entirety.

FIELD

This disclosure relates to the field of portable travel cases. More particularly, this disclosure relates to a portable and modular case for transporting cosmetics and other personal care items.

BACKGROUND

Traveling with cosmetics and other personal care items is typically restricted, such as by rules limiting a volume or container of the cosmetics and personal care items. For example, in the U.S. the Transportation Security Administration implements rules that place strict limits on liquids and gels that may accompany a traveler as part of the traveler's carry-on luggage. The TSA imposes limits to the volume of products that may accompany the traveler. While larger volumes of product may be checked with the traveler's luggage, this is typically undesirable where a traveler is only traveling with carry-on luggage, and in particular business travelers.

While travel sizes of cosmetics and other personal care products are available for purchase, those products are typically provided in containers that are too large for most trips. This results in significantly wasted amounts of products that are not used during travel. A traveler may further accumulate a significant number of products that have not been fully consumed during travel, resulting in further waste. Travel sized products are typically limited in availability. Particular products desired by a traveler may not be available in travel size, therefore requiring the traveler to purchase different items than would normally be desired by the traveler.

Finally, a traveler desiring to bring multiple cosmetics or personal care items in individual travel containers is required to carry several separate containers for those products. Those items may become lost in the traveler's luggage, or the traveler is required to place the items in a baggie within the traveler's luggage. Those items may leak or otherwise spill within the luggage or baggie causing the contents of those items to be leaked onto other items within the traveler's luggage. Further, placing multiple items such as cosmetics and personal care products in separate containers will require a significant amount of space of a traveler's luggage and is undesirable for carry-on luggage.

What is needed, therefore, is a portable and modular case for transporting cosmetics and other personal care items that allows a traveler to transport a desired quantity of cosmetics or personal care items with the traveler.

SUMMARY

The above and other needs are met by a portable and modular case for transporting cosmetics and other personal care items that allows a traveler to transport a desired quantity of cosmetics or personal care items with the traveler. In a first aspect, a modular travel case for transporting personal care items includes: a base having opposing side rails formed along sides of the base, the side rails forming elongate channels therein; a plurality of container modules removably secured on the base, the plurality of container modules having a base plate having a width extending across a width of the base such that sides of the base plate fit within the elongate channels formed by the side rails of the base, one or more containers formed on the base and extending upwardly therefrom, the one or more containers including an open end, and one or more caps secured to the one or more containers over the open end. Sides of the plurality of base plates slidably engage the elongate channels formed on the base such that the plurality of container modules are removably secured to the base.

In one embodiment, the opposing side rails further include closed ends formed on a first end of the base. The closed ends of the opposing side rails prevent sliding of the plurality of container modules from slidably disengaging the base at the first end of the base. In another embodiment, the travel case further includes a retention mechanism formed on the base for securing the plurality of container modules within the elongate channels formed on the base. In yet another embodiment, the retention mechanism includes a plurality of magnets located on at least one of the base and the plurality of container modules.

In one embodiment, the one or more caps are threadably secured to the one or more containers of the plurality of container modules. In another embodiment, the travel case further includes a recess cavity formed on a bottom surface of the base, wherein the recess cavity is located under the base plates of the plurality of container modules when the plurality of container modules are slidably secured on the base. In yet another embodiment, the travel case further includes a spatula shaped to fit within the recess cavity. The spatula is secured in the recess cavity by the plurality of container modules slidably secured to the base.

In one embodiment, the travel case further includes a recessed portion formed on the one or more caps of the plurality of container modules for receiving a label.

In a second aspect, a modular travel case for transporting personal care items includes: a base including opposing side rails formed along sides of the base, the side rails forming elongate channels therein, closed ends formed on a first end of the opposing side rails of the base, and a plurality of magnets located on the base; a plurality of container modules removably secured on the base, the plurality of container modules having a base plate having a width extending across a width of the base such that sides of the base plate fit within the elongate channels formed by the side rails of the base, one or more containers formed on the base and extending upwardly therefrom, the one or more containers including an open end, one or more caps secured to the one or more containers over the open end, and a plurality of magnets located on the base plate. Sides of the plurality of base plates slidably engage the elongate channels formed on the base such that the plurality of container modules are removably secured to the base. The plurality of container modules are removably secured to the base when the plurality of magnets of the base plate are aligned with the plurality of magnets on the base plate of the plurality of container modules.

In one embodiment, the plurality of magnets are embedded within the base plate and the base of the travel case. In another embodiment, the one or more caps are threadably secured to the one or more containers of the plurality of container modules.

In yet another embodiment, the travel case further includes a recess cavity formed on a bottom surface of the base, wherein the recess cavity is located under the base plates of the plurality of container modules when the plurality of container modules are slidably secured on the base. In one embodiment, the travel case further includes a spatula shaped to fit within the recess cavity, wherein the spatula is secured in the recess cavity by the plurality of container modules slidably secured to the base. In another embodiment, the travel case further includes a recessed portion formed on the one or more caps of the plurality of container modules for receiving a label.

In a third aspect, a modular travel case for transporting personal care items includes: a base including opposing side rails formed along sides of the base, the side rails forming elongate channels therein and a recess cavity formed on a bottom surface of the base; a plurality of container modules removably secured on the base, the plurality of container modules having a base plate having a width extending across a width of the base such that sides of the base plate fit within the elongate channels formed by the side rails of the base, one or more containers formed on the base and extending upwardly therefrom, the one or more containers including an open end, and one or more caps secured to the one or more containers over the open end. Sides of the plurality of base plates slidably engage the elongate channels formed on the base such that the plurality of container modules are removably secured to the base. The recess cavity is located under the base plates of the plurality of container modules when the plurality of container modules are slidably secured on the base.

In one embodiment, the opposing side rails further include closed ends formed on a first end of the base. The closed ends of the opposing side rails prevent sliding of the plurality of container modules from slidably disengaging the base at the first end of the base. In another embodiment, the travel case further includes a retention mechanism formed on the base for securing the plurality of container modules within the elongate channels formed on the base. In yet another embodiment, the retention mechanism includes a plurality of magnets located on at least one of the base and the plurality of container modules.

In one embodiment, the one or more caps are threadably secured to the one or more containers of the plurality of container modules. In another embodiment, the travel case further includes a spatula shaped to fit within the recess cavity, wherein the spatula is secured in the recess cavity by the plurality of container modules slidably secured to the base.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
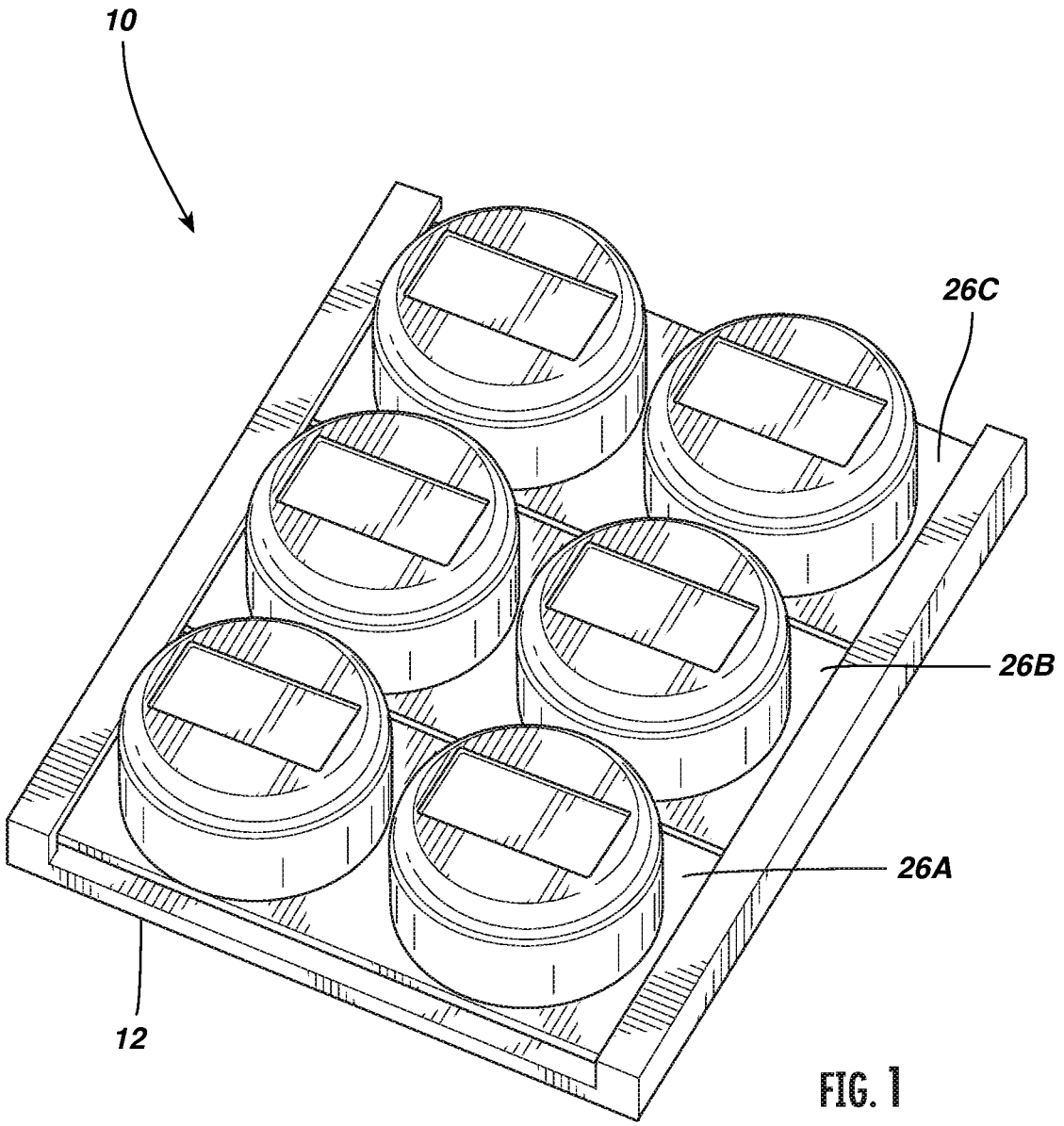
FIG. 1 shows a perspective view of a travel case according to one embodiment of the present disclosure.
Figure 2:
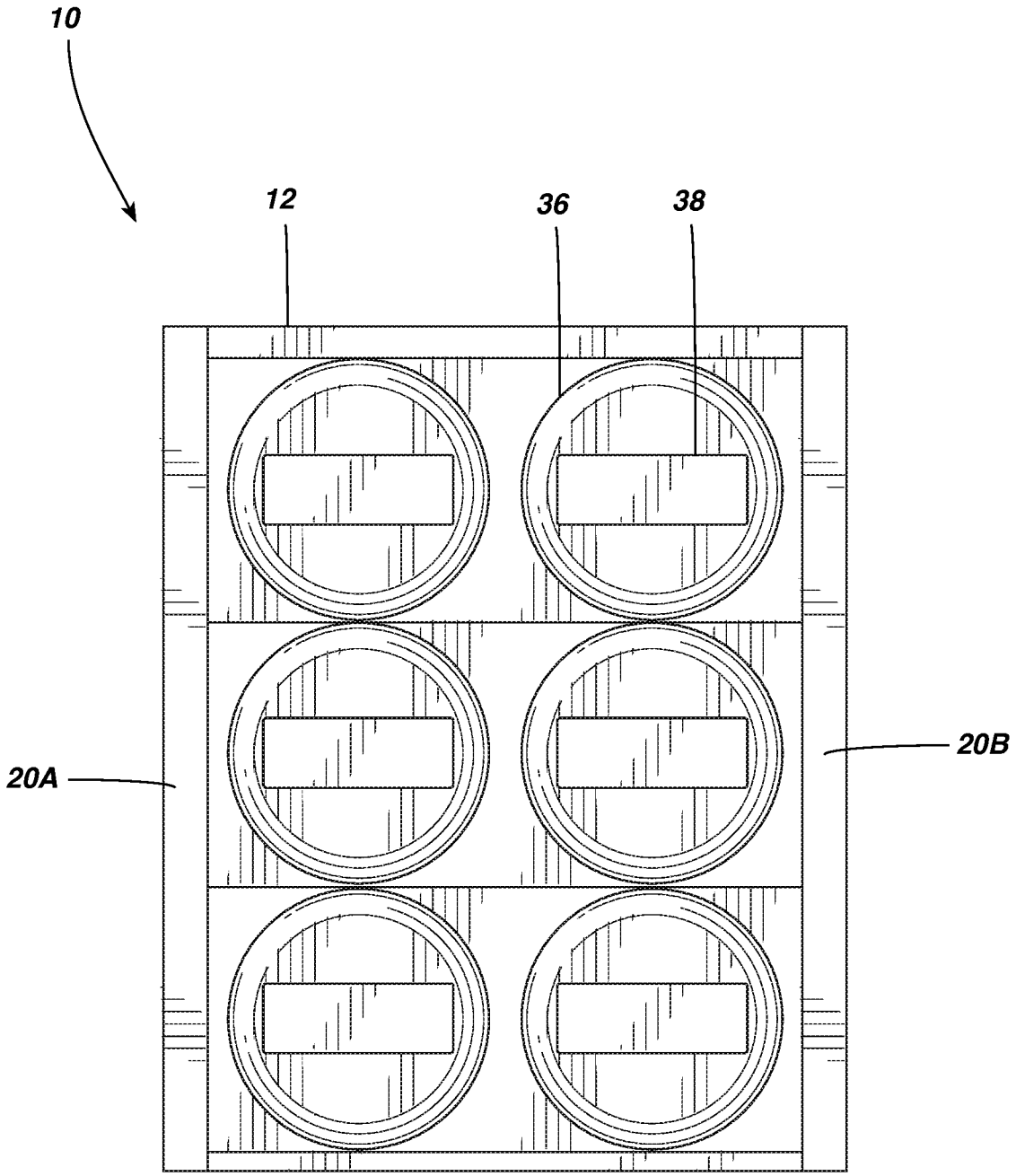
FIG. 2 shows a top view of a travel case according to one embodiment of the present disclosure.

FIG. 1 shows a basic embodiment of a travel case 10 for storing one or more cosmetics and other personal care products during travel. The travel case 10 is modular and preferably configured to securely store multiple cosmetics and personal care products during travel. The travel case 10 is configured to contain cosmetics and personal care products in a plurality of containers and to allow the plurality of containers to be separated from the travel case 10. The travel case 10 advantageously enables multiple cosmetics and personal care products to be stored during travel without requiring a user to utilize multiple individual travel containers.

Figure 3:
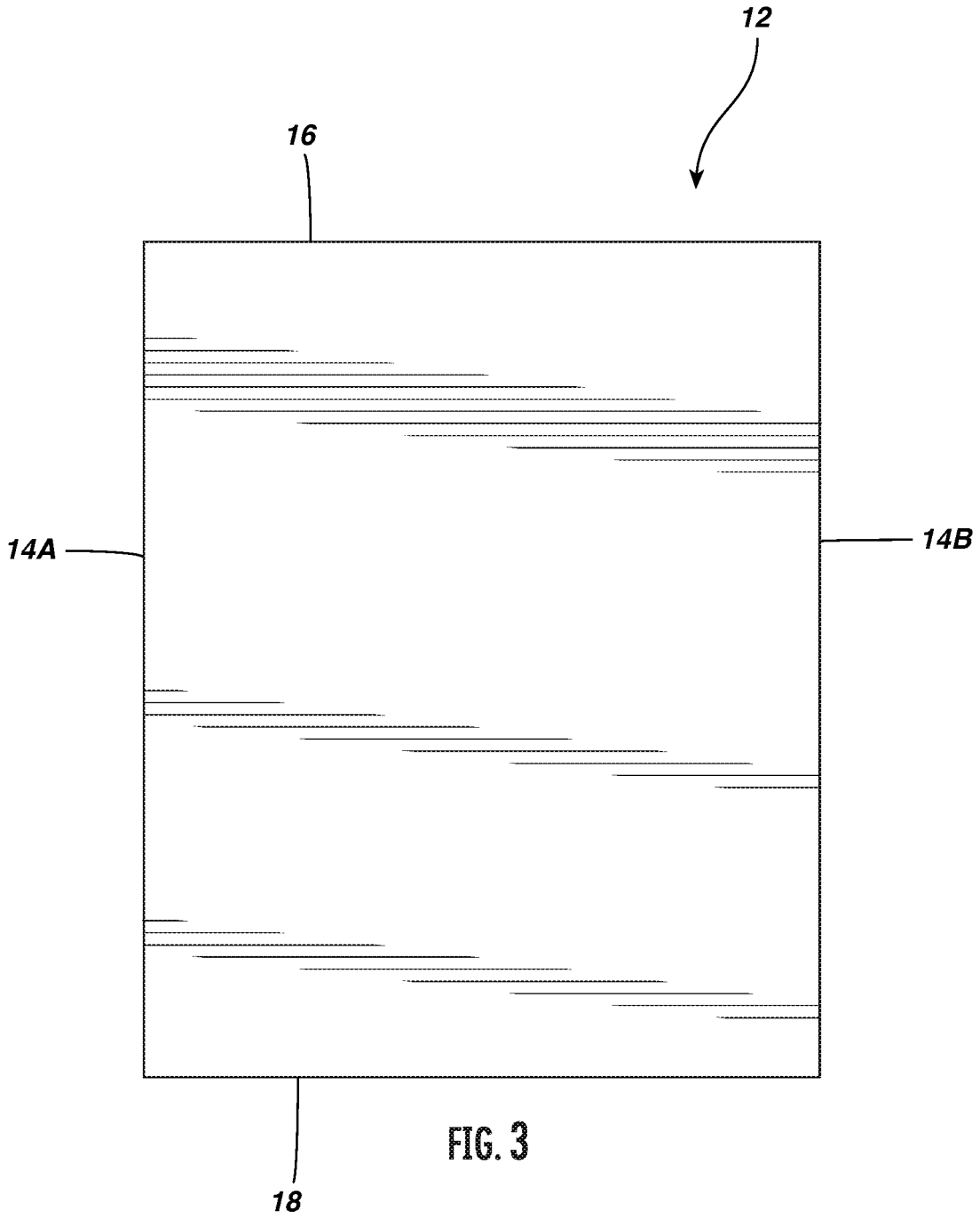
FIG. 3 shows a bottom view of a travel case according to one embodiment of the present disclosure.
Figure 4:
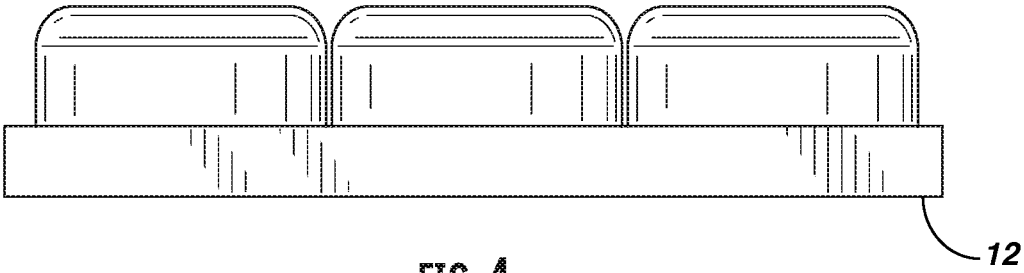
FIG. 4 shows a left side view of a travel case according to one embodiment of the present disclosure.
Figure 5:
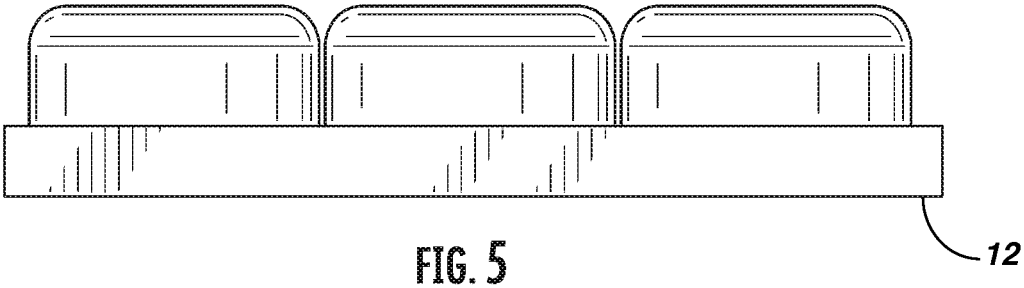
FIG. 5 shows a right side view of a travel case according to one embodiment of the present disclosure.

The travel case 10 includes a base 12. As shown in the bottom view of FIG. 3, the base 12 is preferably planar and rectangular in shape. The base 10 includes opposing sides 14A and 14B. The base 10 further includes a first end 16 and a second end 18 that is distal from the first end 16. While the base 10 is shown in the figures as being rectangular, it is also understood that the base 10 may be formed in various other suitable shapes, such as in a square.

Figure 6:
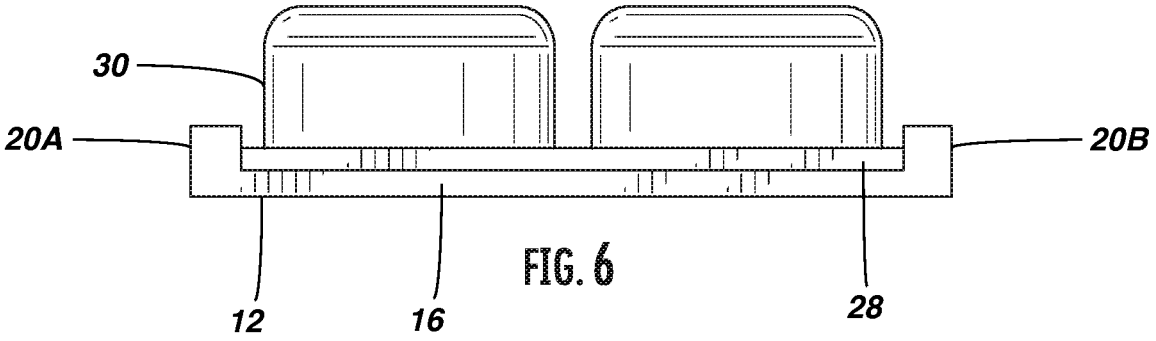
FIG. 6 shows a front view of a travel case according to one embodiment of the present disclosure.
Figure 7:
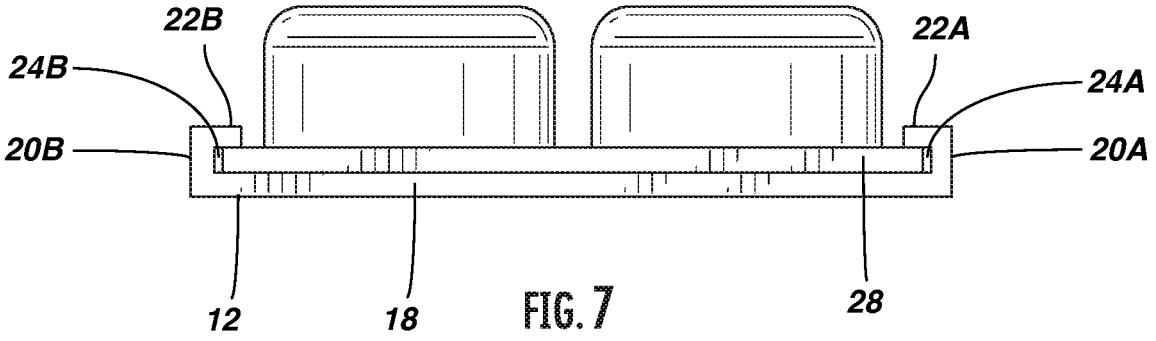
FIG. 7 shows a rear view of a travel case according to one embodiment of the present disclosure.

Referring to FIGS. 6 and 7, the base 12 includes opposing side rails 20A and 20B. The opposing side rails 20A and 20B extend upward from the base 12 and run parallel to one another along a length of the base 12. Opposing inwardly projecting portions 22A and 22B are formed at an upper end of the opposing side rails 20A and 20B and preferably extend along lengths of the opposing side rails 20A and 20B. The opposing side rails 20A and 20B and inwardly projection portions 22A and 22B are preferably arranged such that a pair of elongate channels 24A and 24B are formed along lengths of the opposing sides 14A and 14B of the base.

As shown in FIG. 6, the pair of elongate channel 24A and 24B are preferably closed at an end of the channels 24A and 24B proximate to the first end 16 of the base 12. As shown in FIG. 7, the pair of elongate channels 24A and 24B are preferably open at an end of the channels 24A and 24B proximate to the second end 18 of the base 12.

Referring again to FIG. 1, the travel case 10 includes a plurality of container modules 26A, 26B, and 26C configured to be removably secured to the base 12. Reference herein is made to one of the container modules 26A, and it is understood that each of the container modules 26A, 26B, and 26C may be substantially identical. Alternatively, dimensions and configurations of the plurality of container modules 26A, 26B, and 26C may vary relative to one another depending on a desired configuration of the travel case 10.

The container module 26A includes a base plate 28 sized to extend substantially across a width of the base 12. As shown in FIGS. 6 and 7, the base plate 28 is shaped to fit across a width of the base 12 such that side edges of the base plate 28 extend at least partially into the elongate channels 24A and 24B formed on the base 12. The base plate 28 is preferably planar in shaped and fits adjacent to an upper surface of the base 12 when the base plate 28 is mounted on the base 12 as discussed in greater detail herein.

The container module 26A further includes at least one container 30 formed on the base plate 28 and extending upwardly therefrom. The container 30 extends upwardly from the base plate 28 and defines a cavity 32 (FIG. 8) formed therein. The container 30 is preferably circular in shape as shown in the figures, however it is also understood that the container 30 may be formed into other suitable shapes, such as an oval, square, or rectangle. The container 30 preferably includes threads 34 formed around an outer portion of the container 30. The threads 34 are preferably formed on an outer surface of the container 30 and extend along a height of the container 30. The container preferably has a volume of 3.4 ounces or 100 milliliters, such that an amount of substance storable in the container meets TSA or other regulatory guidelines. It is also understood that a volume of the container may be varied depending on desired uses of the container and applicable regulations for travel.

Each container 30 preferably includes a cap 36 shaped to fit over an open end of the container 30 to secure contents of the container 30. The cap 36 is preferably threadably secured on the container 30 by engaging the threads 34 formed around the outer surface of the container. However, it is also understood that the cap 36 may otherwise be secured to the container 30, such as by securing the cap 36 onto the container 30 with a hinge or other similar mechanism.

The cap 36 preferably includes a recess 38 formed on an upper surface of the cap 36. The recess 38 is preferably shaped to receive a label or other identifier for identification of contents of the container 30. While the figures illustrate a recess 38 formed therein, it is also understood that the cap 36 may include other features for identification of contents of the container 30, such as a flattened area for application of a label or identifying information integrated on the cap 36.

Figure 8:
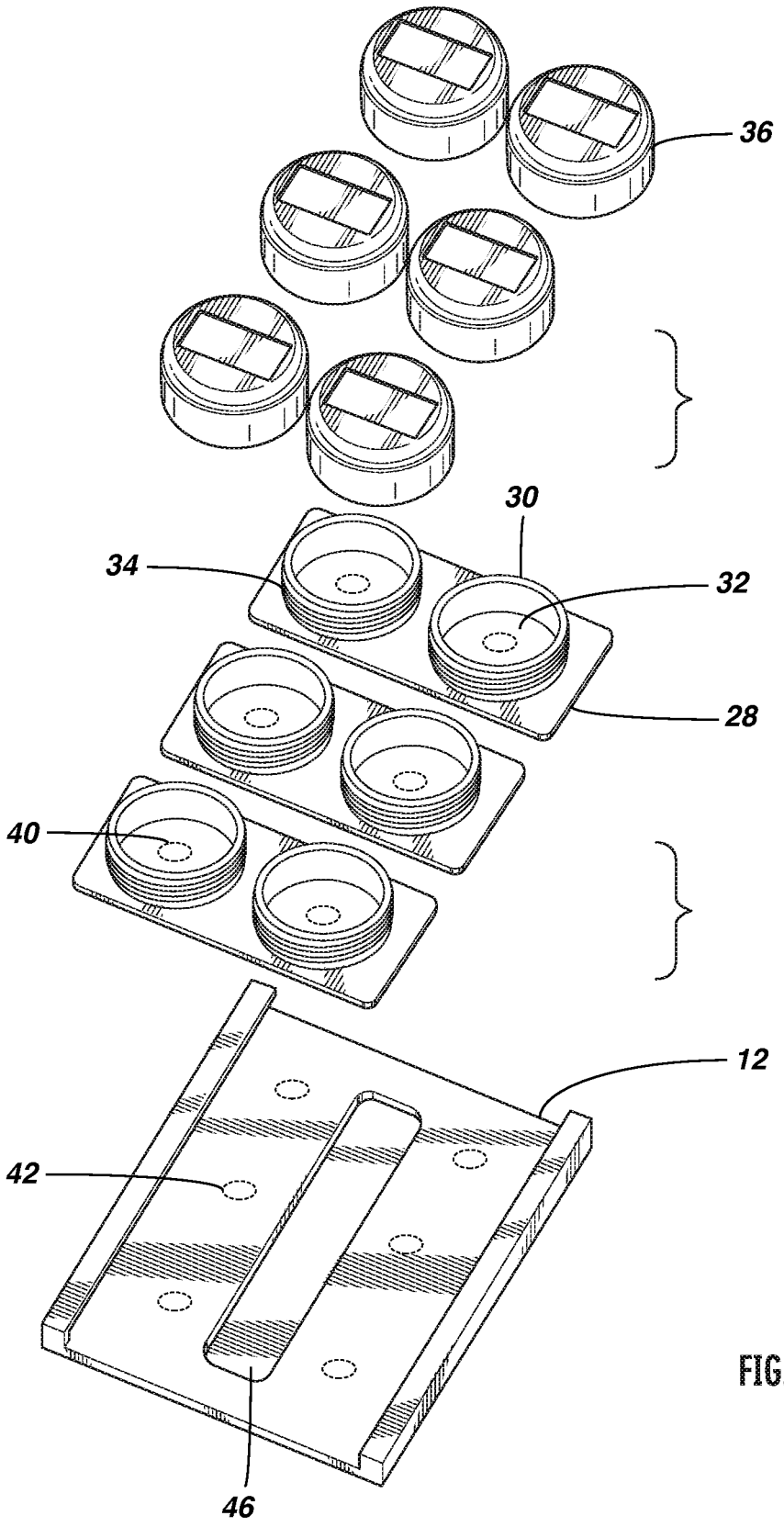
FIG. 8 shows an exploded view of a travel case according to one embodiment of the present disclosure.

Referring to FIG. 8, the plurality of container modules 26A, 26B, and 26C are secured on the base 12 with a retention mechanism. The retention mechanism enables the plurality of container modules 26A, 26B, and 26C to be releasably secured on the base 12 such that a user may readily remove the plurality of container modules 26A, 26B, and 26C from the base.

In one embodiment, as shown in FIG. 8, the retention mechanism includes one or more container magnets 40 and one or more base magnets 42 for securing the plurality of container modules 26A, 26B, and 26C on the base 12. The one or more container magnets 40 are preferably located on the base plate 28, such as by securing the one or more container magnets 40 to the base plate 28 or embedding the one or more container magnets 40 within the base plate 28. The one or more container magnets 40 are preferably located on the base plate 28 under a center of the container 30 formed on the base plate 28.

The one or more base magnets 42 are located on the base 12 and are located such that the one or more base magnets 42 are aligned with the one or more container magnets 40 of the plurality of container modules 26A, 26B, and 26C when the plurality of container modules 26A, 26B, and 26C are slidably engaged with the base 12. The one or more base magnets 42 may be located on an upper surface of the base 12 such that the one or more base magnets 42 are proximate to the one or more container magnets 40. The one or more base magnets 42 are preferably embedded within the base 12.

Figure 9:
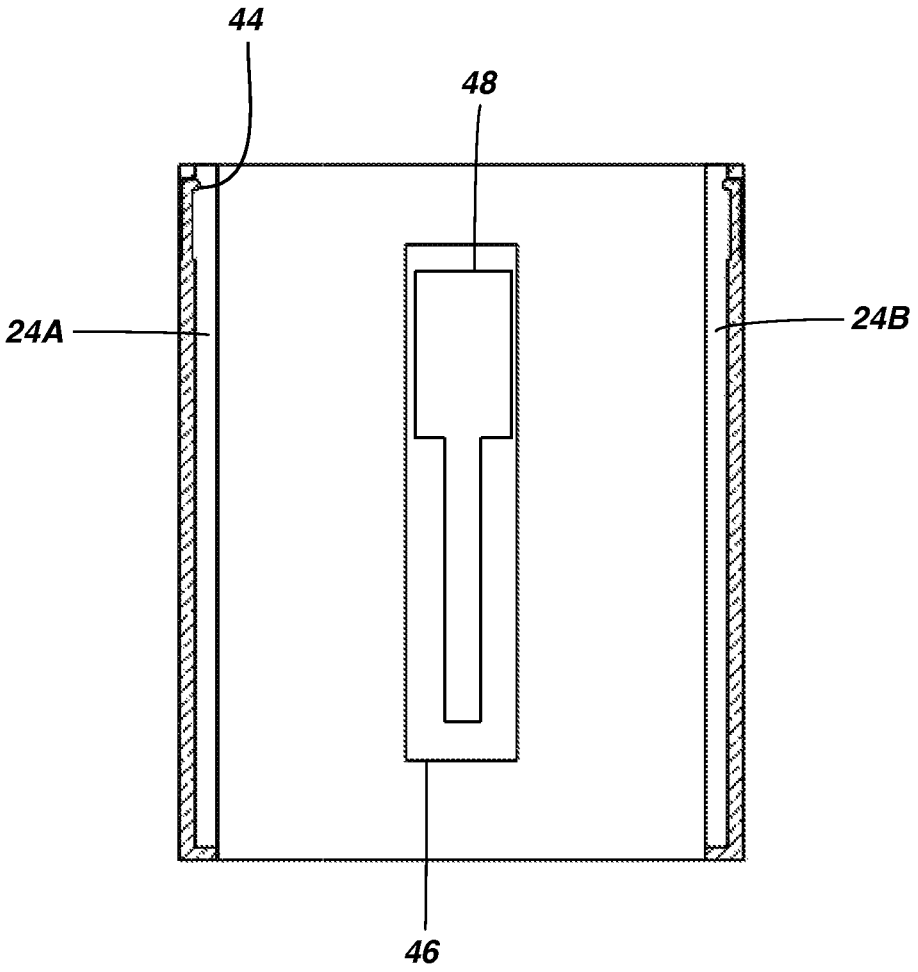
FIG. 9 shows a cross-sectional top view of a base of a travel case according to one embodiment of the present disclosure.

Referring now to FIG. 9, in another embodiment, the retention mechanism may include a clip 44 for securing the plurality of container modules 26A, 26B, and 26C on the base 12. The clip 44 is preferably formed on one or both of the elongate side rails 20A and 20B and extends into the elongate channels 24A and 24B of the base. The clip 44 is preferably resiliently flexible and projects into the elongate channels 24A and 24B to engage the base plate 28 of at least one of the plurality of container modules 26A, 26B, and 26C. The plurality of container modules 26A, 26B, and 26C are secured within the elongate channels 24A and 24B between the first end 16 and the second end 18 of the base 12.

Referring again to FIG. 8, the base 12 preferably includes a recess 46 formed on an upper surface of a planar portion of the base 12. The recess 46 is preferably elongate in shape and extends along a length of the base 12. The recess 46 is preferably positioned on the base such that the recess 46 is concealed behind the plurality of container modules 26A, 26B, and 26C when they plurality of container modules 26A, 26B, and 26C are located on the base 12. As shown in FIG. 9, the recess 46 is preferably shaped to receive a spatula 48 or other applicator within the recess 46. The spatula 48 is secured in the recess by the plurality of container modules 26A, 26B, and 26C slidably engaged with the base 12.

In use, the travel case 10 is configured to contain multiple cosmetics or other personal care products items such as soaps, shampoos, lotions, and other luxury items within the containers 30 of the plurality of container modules 26A, 26B, and 26C. A user may place contents into the container 30 and subsequently secure the plurality of container modules 26A, 26B, and 26C to the base 12 by slidably engaging the base 12. The plurality of containers modules 26A, 26B, and 26C are secured to the base with the retention mechanism to prevent the container modules 26A, 26B, and 26C from disengaging the base during travel. When the user reaches a desired location, the plurality of container modules 26A, 26B, and 26C may be removed from the base 12.

As shown in the figures, the travel case 10 may be configured to transport six different cosmetics or personal care products on the plurality of container modules 26A, 26B, and 26C. The arrangement of container modules 26A, 26B, and 26C as shown may be adjusted based on a desired number of cosmetics or personal care products to be transported. For example, the travel case 10 may be provided with four containers instead of six as illustrated. Further, each of the container modules may be configured to include only a single container or more than two containers depending on a desired configuration.

Embodiments of the travel case described herein advantageously enable a user to transport multiple cosmetics and other personal care products during travel. The user may carry multiple cosmetics and personal care products in a single case carried in luggage of the user while allowing the user to separate individual containers after reaching a destination. The user may refill contents of the containers of the travel case from other containers without requiring the user to purchase travel-sized containers of product.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A modular case comprising:

a base having opposing side rails formed along sides of the base and extending along a length of the base, the side rails forming elongate channels therein, the base including a plurality of base magnets embedded on the base;

a plurality of container modules removably secured on the base, the plurality of container modules having a base plate having a width extending across a width of the base, the base plate having a thickness such that sides of the base plate fit at least partially within the elongate channels formed by the side rails of the base, the base plate including one or more container magnets embedded therein, two or more discrete containers shaped to contain one of a viscous and liquid item therein, the two or more containers spaced apart on the base plate and extending upward from a surface of the base plate, the two or more containers including an upper open end, and a cap removably secured over the open upper end of each of the two or more discrete and spaced apart containers over the open end to form a seal over the upper open end of each of the two or more containers to retain the one of a viscous and liquid item within each of the two or more containers;

wherein sides of the plurality of base plates slidably engage the elongate channels formed on the base such that the plurality of container modules are removably secured horizontally along a length of the base during transport of the modular case; and wherein when the plurality of container modules are located on the base, the one or more container magnets embedded on the container modules are aligned over the one or more base magnets embedded on the base to secure the plurality of container modules in a desired location on the base during transportation of the modular case.

2. The modular case of claim 1, the opposing side rails further comprising closed ends formed on a first end of the base, wherein the closed ends of the opposing side rails prevent sliding of the plurality of container modules from slidably disengaging the base at the first end of the base.

3. The modular case of claim 1, wherein the plurality of base magnets embedded on the base and the plurality of container magnets embedded on the base plate of the plurality of container modules are circular in shape and wherein outer edges of the plurality of base magnets and the plurality of container magnets are aligned when the plurality of container modules are on the base.

4. The modular case of claim 1, wherein the caps are threadably secured over each of the two or more containers of the plurality of container modules.

5. The modular travel case of claim 1, further comprising a recess cavity formed on a bottom surface of the base, wherein the recess cavity is located under the base plates of the plurality of container modules when the plurality of container modules are slidably secured on the base.

6. The modular travel case of claim 4, further comprising a spatula shaped to fit within the recess cavity, wherein the spatula is secured in the recess cavity by the plurality of container modules slidably secured to the base.

7. The modular travel case of claim 1, further comprising a recessed portion formed on the caps of the plurality of container modules for receiving a label.

8. A modular case comprising:

a base including a base having opposing side rails formed along sides of the base and extending along a length of the base, the side rails forming elongate channels therein, the base including a plurality of base magnets embedded on the base;

closed ends formed on a first end of the opposing side rails of the base;

a plurality of container modules removably secured on the base, the plurality of container modules having a base plate having a width extending across a width of the base, the base plate having a thickness such that sides of the base plate fit at least partially within the elongate channels formed by the side rails of the base, the base plate including one or more container magnets embedded therein, two or more circular discrete containers shaped to contain one of a viscous and liquid item therein, the two or more containers spaced apart on the base and extending upwardly from a surface of the base plate, the two or more containers including an open upper end, and one or more circular caps threadably secured over the upper open end of each of the two or more discrete and spaced apart containers to form a seal over the upper open end of each of the two or more containers to retain the one of a viscous and liquid item within the two or more containers;

wherein sides of the plurality of base plates slidably engage the elongate channels formed on the base such that the plurality of container modules are removably secured horizontally along a length of the base during transport of the modular case; and wherein when the plurality of container modules are located on the base, the one or more container magnets embedded on the container modules are aligned over the one or more base magnets embedded on the base to secure the plurality of container modules in a desired location on the base during transportation of the modular case.

9. The modular travel case of claim 8, wherein the plurality of base magnets embedded on the base and the plurality of container magnets embedded on the base plate of the plurality of container modules are circular in shape and wherein outer edges of the plurality of base magnets and the plurality of container magnets are aligned when the plurality of container modules are on the base.

10. The modular travel case of claim 8, wherein the one or more caps are threadably secured to the two or more containers of the plurality of container modules.

11. The modular travel case of claim 8, further comprising a recess cavity formed on a bottom surface of the base, wherein the recess cavity is located under the base plates of the plurality of container modules when the plurality of container modules are slidably secured on the base.

12. The modular travel case of claim 11, further comprising a spatula shaped to fit within the recess cavity, wherein the spatula is secured in the recess cavity by the plurality of container modules slidably secured to the base.

13. The modular travel case of claim 12, further comprising a recessed portion formed on the one or more caps of the plurality of container modules for receiving a label.

14. A modular travel case for transporting items, the modular travel case comprising:

a base including opposing side rails formed along sides of the base and extending along a length of the base, the side rails forming elongate channels therein, a recess cavity formed on a bottom surface of the base, and a plurality of base magnets embedded on the base;

a plurality of container modules removably secured on the base, the plurality of container modules having a base plate having a width extending across a width of the base such that sides of the base plate fit within the elongate channels formed by the side rails of the base, the base plate including one or more container magnets embedded therein, two or more discrete containers shaped to contain a one of a viscous and liquid item therein, the two or more containers spaced apart on the base and extending upwardly from a surface of the base plate, the two or more containers including an open upper end, and a cap removably secured over the open upper end of each of the two or more containers to form a seal over the upper open end of each of the two or more containers;

wherein the sides of the plurality of base plates slidably engage the elongate channels formed on the base such that the plurality of container modules are removably secured horizontally along a length of the base during transport of the modular case; and wherein the recess cavity is located under the base plates of the plurality of container modules when the plurality of container modules are slidably secured on the base; and wherein when the plurality of container modules are located on the base, the one or more container magnets embedded on the container modules are aligned over the one or more base magnets embedded on the base to secure the plurality of container modules in a desired location on the base during transportation of the modular travel case.

15. The modular travel case of claim 14, the opposing side rails further comprising closed ends formed on a first end of the base, wherein the closed ends of the opposing side rails prevent sliding of the plurality of container modules from slidably disengaging the base at the first end of the base.

16. The modular case of claim 15, wherein the plurality of base magnets embedded on the base and the plurality of container magnets embedded on the base plate of the plurality of container modules are circular in shape and wherein outer edges of the plurality of base magnets and the plurality of container magnets are aligned when the plurality of container modules are on the base.

17. The modular travel case of claim 14, wherein the caps are threadably secured to the two or more containers of the plurality of container modules.

18. The modular travel case of claim 14, further comprising a spatula shaped to fit within the recess cavity, wherein the spatula is secured in the recess cavity by the plurality of container modules slidably secured to the base.

* * * * *